US005163832A

United States Patent [19]

Ishii et al.

[11] Patent Number: 5,163,832

[45] Date of Patent: Nov. 17, 1992

[54] VERTICAL HEAT-TREATING APPARATUS

[75] Inventors: Katsumi Ishii, Fujino; Shingo Watanabe, Aikawa; Mitsuo Kato, Sagamihara, all of Japan

[73] Assignee: Tokyo Electron Sagami Limited, Kanagawa, Japan

[21] Appl. No.: 605,377

[22] Filed: Oct. 30, 1990

[51] Int. Cl.[5] ..... F27B 5/00; F27B 9/02; F27D 3/00

[52] U.S. Cl. ..... 432/244; 432/239; 432/253

[58] Field of Search ..... 432/239, 241, 253; 219/411

[56] References Cited

U.S. PATENT DOCUMENTS

| | | | |
|---|---|---|---|
| 4,459,104 | 7/1984 | Wollmann | 432/239 X |
| 4,468,195 | 8/1984 | Sasaki et al. | 432/239 X |
| 4,610,628 | 9/1986 | Mizushina | 432/241 |
| 4,669,983 | 6/1987 | Hayward | 432/253 X |
| 4,738,618 | 4/1988 | Massey et al. | 432/208 X |
| 4,938,691 | 7/1990 | Ohkase et al. | 432/253 X |
| 4,954,684 | 9/1990 | Aoki et al. | 219/411 X |
| 4,976,613 | 12/1990 | Watanabe | 432/241 |
| 4,981,436 | 1/1991 | Watanabe | 432/241 |

*Primary Examiner*—Henry A. Bennet
*Assistant Examiner*—Christopher Kilner
*Attorney, Agent, or Firm*—Oblon, Spivak, McClelland, Maier & Neustadt

[57] ABSTRACT

A vertical heat-treating apparatus which allows effective use of an installation space and improved productivity is disclosed. In this system, a plurality of housings, each accommodated with a vertical reactor, are aligned with each other. A gas feed unit and the like are arranged in front of each housing with a space disposed therebetween for conducting maintenance work. A rail is installed along the rear side of the housings. A boat liner is located on the rail for carrying a boat to the housings. An interface mechanism including a horizontal-vertical conversion handling unit for supplying the boat in a vertical state to the boat liner is disposed near the rail.

7 Claims, 6 Drawing Sheets

VERTICAL HEAT-TREATING APPARATUS

BACKGROUND OF THE INVENTION

1. Field of the Invention

The present invention relates to a vertical heat-treating apparatus constituted by a plurality of substantially vertical reactor bodies aligned with each other.

2. Description of the Related Art

As a conventional heat-treating apparatus for heating a substrate to be treated, such as a semiconductor wafer, to form a thin film or to perform thermal diffusion, a horizontal heat-treating apparatus constituted by a horizontally arranged reaction tube has been mainly used. However, in recent years, a vertical heat-treating apparatus constituted by a substantially vertically arranged reaction tube has been put into use.

That is, in the vertical heat-treating apparatus, a reactor body comprising a cylindrical reaction tube made of quartz or the like, a heater provided to surround the reaction tube, a holding tube, a heat insulator, or the like is almost vertically arranged. A large number of semiconductor wafers are stacked at intervals on a wafer boat made of quartz or the like, and the semiconductor wafers are loaded/unloaded in the reaction tube by, e.g., a conveying mechanism which can be vertically moved.

In this apparatus, various gases or the like must be supplied to the reactor body to treat an object stored in the reactor. Therefore, other various units 24 (to be also referred to as a gas feed unit of a source gas and the like) are arranged, for example, as shown in FIG. 1 with respect to an installation area 25 of a reactor body 21.

In this case, a maintenance operation for the reactor body 21 is performed in directions of, e.g., arrows "a", and a maintenance operation for the other various units is performed from almost four sides of a frame (housing) in directions of arrows "b".

In the vertical heat-treating apparatus, since a wafer boat can be loaded/unloaded without contacting the inner wall of the reaction tube, almost no particles are generated, an occupied area is small, and the diameter of the semiconductor wafer to be treated can be easily increased.

However, in the conventional vertical heat-treating apparatus, when a maintenance area along the four sides of the apparatus is required and the vertical heat-treating apparatuses are sequentially aligned with each other, the maintenance space between the apparatuses is increased, and the installation floor space is inefficiently used. In order to align all the apparatuses as a system, a semiconductor wafer to be treated must be conveyed for a long distance, and efficiency of the treatment is reduced.

SUMMARY OF THE INVENTION

The present invention is made to solve the above problems, and has as its object to provide a vertical heat-treating apparatus which allows effective use of a space compared with the prior art and which improves productivity.

According to the present invention, there is provided a vertical heat-treating apparatus including a series of substantially box-like first housings which are aligned with each other so that side surfaces thereof closely oppose each other, each of which has a closed top portion, an opening chiefly for carrying out maintenance in a rear surface thereof, an opening for mainly loading or unloading a boat in a front surface thereof, an upper portion storing a substantially vertical reactor body, and a lower portion storing an elevator for vertically moving a boat storing a plurality of plate-like objects into the reactor;

a series of second housings accommodating therein various apparatus for supplying various kinds of gas, power for treating an object to be treated (hereinafter refered to as utility boxes), which are arranged behind the housings with a space being left for maintenance;

a transfer means or rail installed along the series of the first housings;

a boat liner, which is arranged to be movable on the transfer means, an upper surface of which has a boat mounting table which is movable in the opening in the front surface of each of the series of first housings;

a transfer mechanism for transferring the plate-like object to or from the boat in a horizontal state;

an interface mechanism arranged between the transfer means and the transfer mechanism for converting a state or orientation of the boat into a substantially vertical state (or vice versa) to transfer the boat to or from the boat liner thereby transporting the boat between the boat liner and the transfer mechanism.

Note that a partition is arranged so that a front opening portion of each first housing is exposed on a clean room side, and the rear wall portion of each first housing is exposed on a maintenance room side. By the partition, the transfer means, the boat liner, the transfer mechanism and the interface mechanism are located on the clean room side, and the utility box is located on the maintenance room side. By holding the clean room at a positive pressure relative to the maintenance room, the plate-like object can be kept clean during the treatment.

In a vertical heat-treating apparatus having the above arrangement according to the present invention, a maintenance space need not be provided between housings. As a result, the conveying distance of the semiconductor wafer to be treated can be decreased. In addition, since a system which is commonly applicable to a plurality of reactor bodies is used as a means for transporting the boat, an installation space can be effectively used and productivity can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of a vertical heat-treating apparatus—according to the present invention will be described below with reference to the accompanying drawings.

Figure 1:
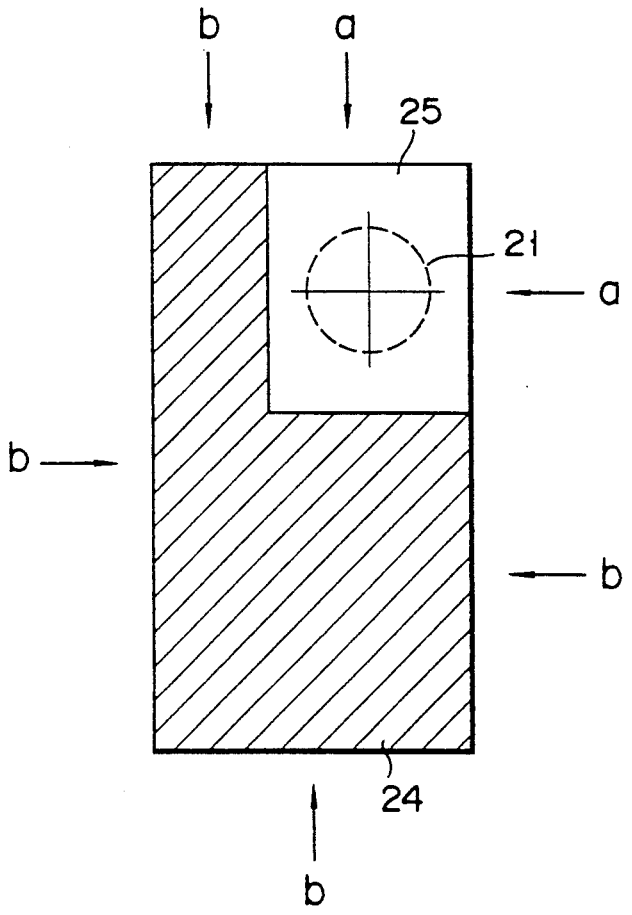
FIG. 1 (PRIOR ART)
FIG. 1 is a diagram of the layout of a conventional vertical heat-treating apparatus.
Figure 2:
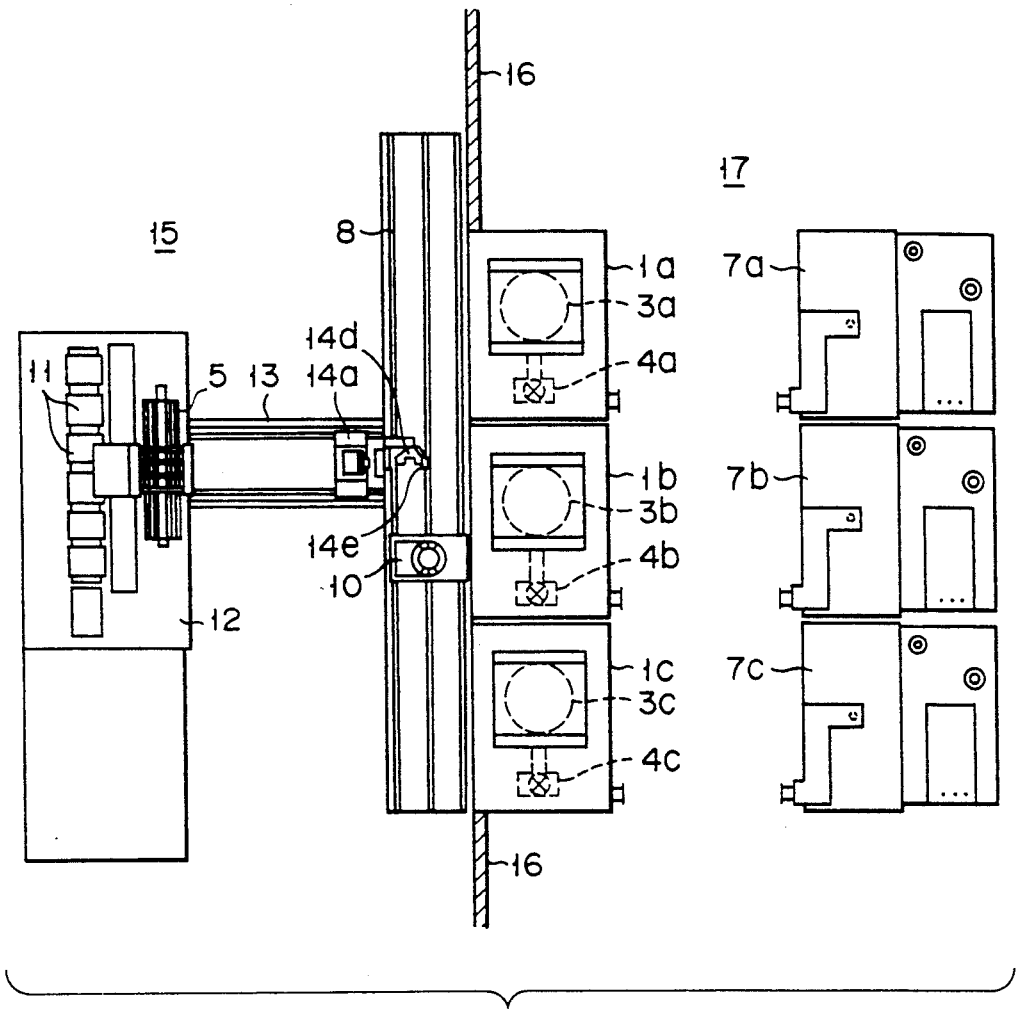
FIG. 2 is a plan view of a vertical heat-treating apparatus according to an embodiment of the present invention.
Figure 3:
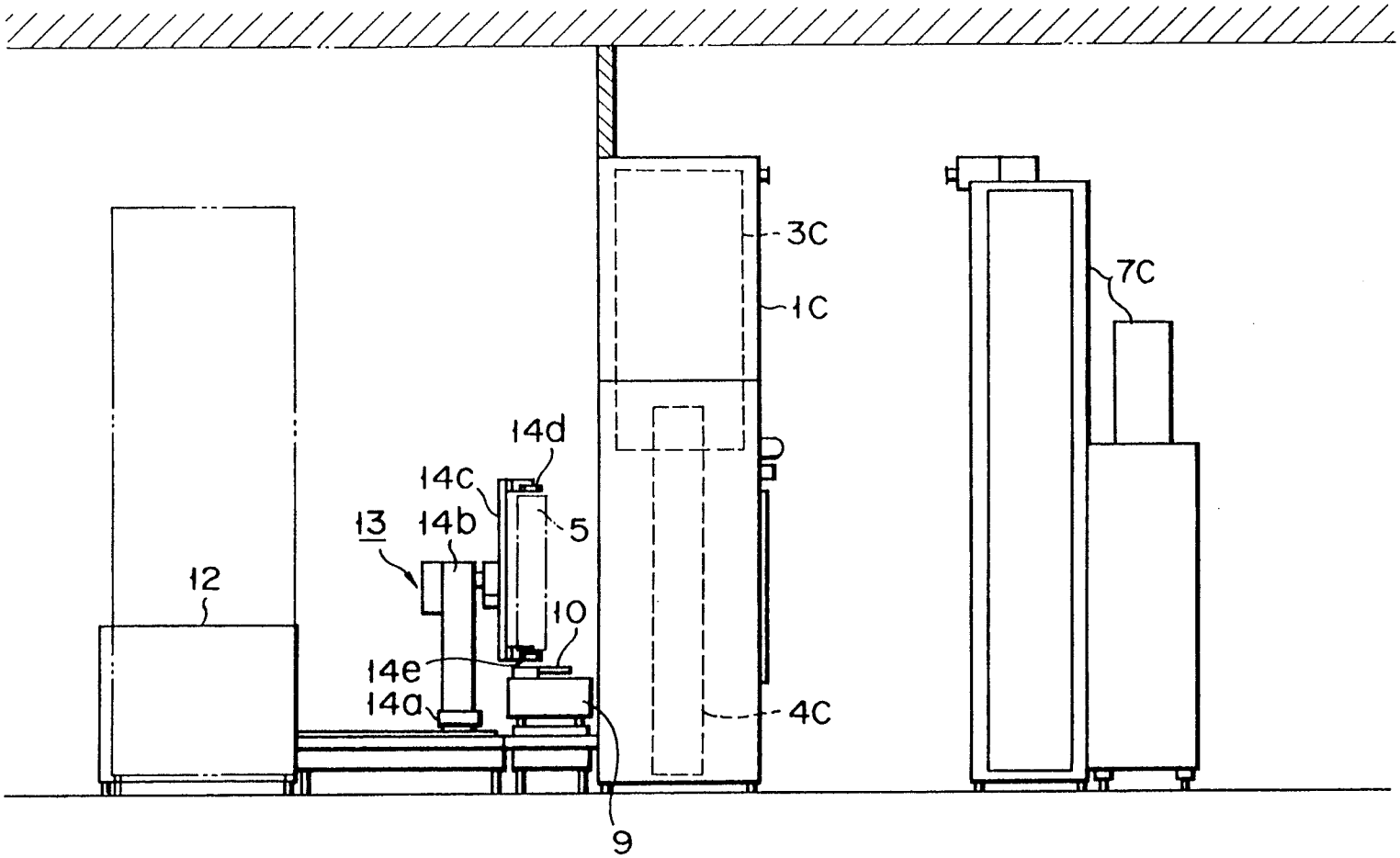
FIG. 3 is a side view of the vertical heat-treating apparatus of FIG. 2.
Figure 4:
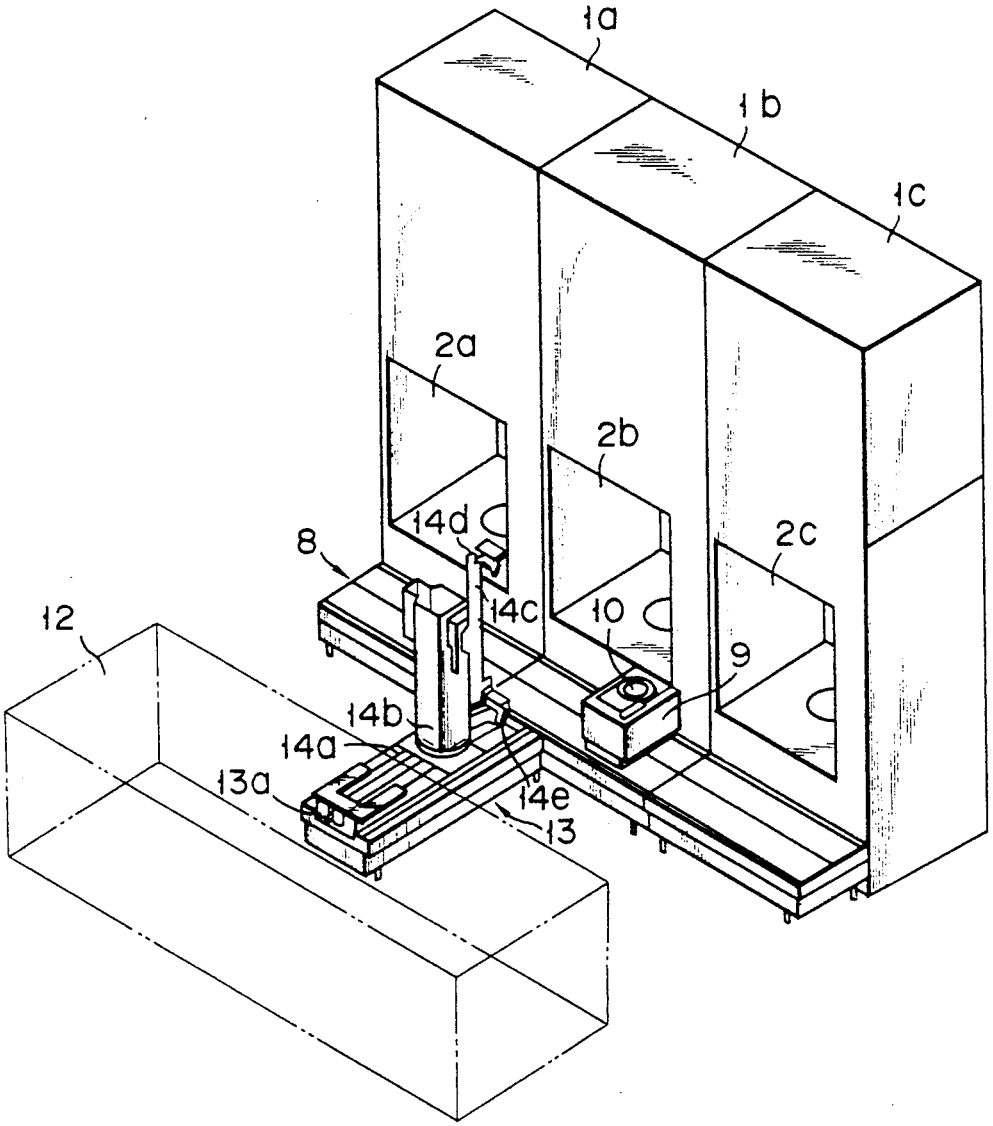
FIG. 4 is a perspective view of a main part of the vertical heat-treating apparatus of FIG. 2.

In accordance with a first embodiment of the present invention three reactors are aligned with each other as shown in FIGS. 2 to 4. However, the number of reactors is not limited to the three and may be arbitrarily selected as needed.

FIG. 2 is a plan view showing a vertical heat-treating apparatus according to this embodiment, FIG. 3 is a side view showing the vertical heat-treating apparatus in FIG. 2, and FIG. 4 is a perspective view showing part of the vertical heat-treating apparatus.

In this embodiment, reference numerals 1*a* to 1*c* denote housings (or first housings). As shown in FIG. 4, the vertically oblong box-like housings have closed tops and openings 2*a*, 2*b*, and 2*c* in lower portions of the front surfaces, respectively. Substantially vertical reactor bodies 3*a*, 3*b*, and 3*c* are respectively stored in the upper portions of the housings. Elevators 4*a*, 4*b*, and 4*c* are also provided for vertically moving a boat 5 storing a plurality of plate-like objects such as semiconductor wafers into the reactors, with the elevators arranged in the lower portions of the housings. Each of the reactor bodies 3*a*, 3*b*, and 3*c* is constituted by a cylindrical reactor tube made of quartz, which is surrounded by a soaking tube, tubular heater and a tubular heat insulator, respectively. The boat 5 is made of, e.g., quartz and formed to store a large number of plate-like objects such as semiconductor wafers in parallel and an upright manner. These housings 1*a*, 1*b*, and 1*c* thus constructed are aligned with each other so that their respective side surfaces closely oppose each other to form a series of housings.

Utility boxes (or second housings) 7*a*, 7*b*, and 7*c* housing a control device such as a computer or the like, for supplying gases and powers required for the reactor bodies 3*a*, 3*b*, and 3*c*, and for treating objects stored in the reactors are respectively arranged in the rear sides of housings 1*a*, 1*b*, and 1*c* with a space to allow a maintenance operation for each unit, e.g., the space of 120 cm. In addition, piping for various gases and the air, a power source cable, a power cable, a cable for an electric signal, piping for a cooling water (every cable and piping is not shown), or the like are arranged between the housings 1*a*, 1*b*, and 1*c* and the utility boxes 7*a*, 7*b*, and 7*c* extending, for example, overhead of them.

As a boat transporting means for supplying a boat to each of the housings 1*a*, 1*b* and 1*c*, a transfer means or rail 8 is installed along the rear surfaces of the housings 1*a*, 1*b*, and 1*c*. A boat liner 9 is movably arranged on the transfer means 8. A boat mounting table 10, which is movable toward the openings 2*a*, 2*b*, and 2*c* in the front surfaces of the housings 1*a*, 1*b*, and 1*c*, is arranged on the upper surface of the boat liner 9.

A wafer transfer mechanism 12 is arranged to transfer a plurality of plate-like objects such as semiconductor wafers from a cassette 11 storing them to the boat 5 in a horizontal state.

That is, the wafer transfer mechanism 12 is arranged so that, e.g., every twenty five semiconductor wafers are simultaneously transferred from the cassette 11 through a robot hand to a predetermined portion of the boat 5 in the horizontal state for example and that the treated wafers on the boat 5 are simultaneously taken out and automatically stored in the cassette 11.

An interface mechanism 13 is arranged between the transfer means 8 and the transfer mechanism 12. The interface mechanism 13 receives the boat 5 loaded with wafers by the both sides thereof in a horizontal state or orientation from the transfer mechanism, converts the horizontal state of the boat 5 to the vertical state by means of a rotating mechanism, and then transfers the boat 5 on the boat liner. In the same manner, the interface mechanism 13 performs the same operations as mentioned above, but in reverse order.

The interface mechanism 13 is arranged as follows. A base 13*a* is arranged to connect the transfer means 8 to the transfer mechanism 12. A movable table 14*a* (which can be moved along the base 13*a*) and a strut 14*b* are arranged on the base 13*a*. The strut 14*b* can be rotated about its axis within a range of 1801 or more. A conversion arm 14*c* for converting the posture of the boat from the horizontal state to the vertical state (or vice versa) is provided and can be rotated within a range of 90' or more in a plane substantially parallel to one side surface of the strut 14*b*. The conversion arm 14*c* can also be vertically moved and is arranged on the surface of the strut 14*b*. An upper boat hand 14*d* and a lower boat hand 14*e* for supporting the boat 5 are arranged on both ends of the conversion arm 14*c*. The upper and lower boat hands 14*d* and 14*e* can support the boat 5 almost in a horizontal or vertical state.

Partitions 16 are arranged to expose only the front surfaces of the housings 1*a*, 1*b*, and 1*c* aligned in a line on a clean room 15 side (refer to FIGS. 2 and 3). By the partitions 16, the transfer means 8, the boat liner 9, the transfer mechanism 12, and the interface mechanism 13 are located on the clean room 15 side. In addition, by the partitions 16, the utility boxes 7*a*, 7*b*, and 7*c* are located on a maintenance room 17 side. The clean room 15 side is always kept at a positive pressure relative to the maintenance room during the treatment. As a result, a plate-like object such as a semiconductor wafer can be kept clean under the environment of the clean room 15.

An operation of a vertical heat-treating apparatus according to this embodiment will be described below. In the transfer mechanism 12, for example, one hundred semiconductor wafers which correspond to four cassettes (each containing 25 wafers) are transferred through a predetermined program and order to the boat 5 in a horizontal state. The interface mechanism 13 is operated so that the boat 5 in a horizontal state is received by the both sides thereof by a robot arm of the conversion arm 14*c*. The conversion arm 14*c* is rotated at a non-interfering position to convert the state of the boat 5 to the vertical state.

Next, the interface mechanism 13 carries the boat in the vertical state to the boat liner 9 which is stopped in advance at a boat-transferring cite of the transfer means 8, and the boat 5 is transferred to the boat mounting table 10 of the boat liner 9 while keeping the boat 5 in the vertical state. The boat liner 9 mounting the boat 5 in the vertical state is moved to the front surface of a predetermined one of the housings 1*a* to 1*c* along the transfer means 8. The boat mounting table 10 is extended in a direction of the openings 2*a*, 2*b*, or 2*c* of the housing 1*a*, 1*b*, or 1*c* to transfer the boat 5 in the vertical state to the elevator 4*a*, 4*b*, or 4*c* through a boat-handling mechanism or transfer device (not shown). The boat 5 is transferred to a predetermined axial portion of the reactor body 3*a*, 3*b*, or 3*c*, and after closing the opening near the bottom of the reactor a predetermined treatment such as CVD, thermal diffusion, or annealing is performed. After the completion of the treatment, the boat 5 is returned in the order opposite to the above order.

A maintenance operation such as a replacement of reaction tubes in the reactor bodies 3*a* to 3*c* and a maintenance operation of the utility boxes 7*a*, 7*b*, and 7*c* are performed from a space between the housings 1*a* to 1*c* and the utility boxes 7*a*, 7*b*, and 7*c*. That is, covers are hinged or detachably arranged on the maintenance room 17 side of the housings 1*a* to 1*c* and the maintenance operations are performed while the covers are opened or detached. Therefore, maintenance can be performed from the rear side without contaminating the clean room located on the front side of the housings 1*a* to 1*c*.

That is, in a vertical heat-treating apparatus according to this embodiment, the housings 1*a* to 1*c* respectively storing the reactor bodies 3*a* to 3*c* are aligned in a line along a boundary between the clean room 15 and the maintenance room 17, and a space for performing a maintenance operation is arranged behind the housings. The utility boxes 7*a* to 7*c* of a source gas and the like are arranged in the space. Therefore, a large number of semiconductor wafers can be treated by the three reactor bodies 3*a* to 3*c*, and a floor area required for installing the apparatus, more specifically, an installation area for the clean room 15 can be largely decreased as compared with a conventional case wherein three vertical heat-treating apparatuses are arranged, thereby efficiently using the space.

In addition, since a space between vertical heat-treating apparatuses is not required, a conveying distance of the boat 5 can be reduced, and production efficiency can be improved. Further, it is also possible to linearly arrange a larger number of the housings in series by extending the length of the transfer means 8.

Note that, the layout of the housings 1*a* to 1*c*, the utility boxes 7*a* to 7*c*, the transfer means 8, the transfer mechanism 12, and the interface mechanism 13 is not limited to that of the above embodiment and can be easily changed.

Figure 5:
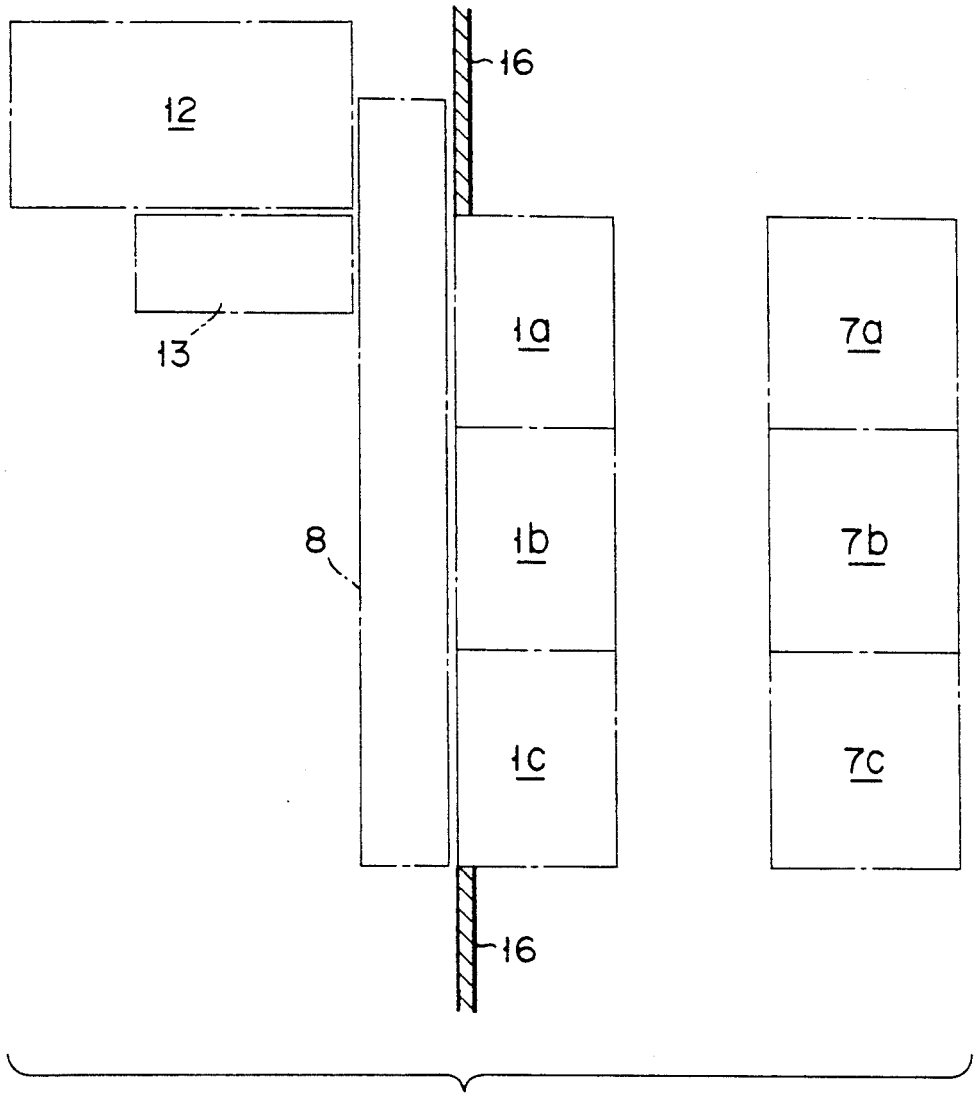
FIGS. 5 and 6 are diagrams showing modifications of the layout of a vertical heat-treating apparatus according to the present invention.
Figure 6:
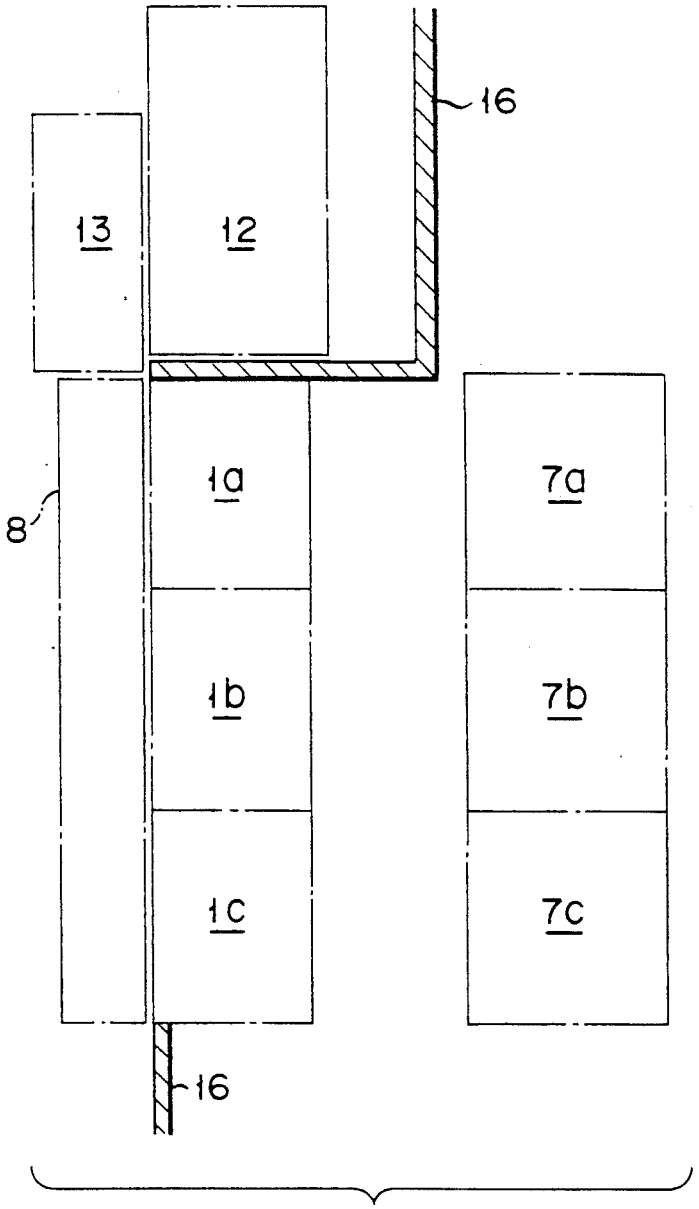

For example, as shown in FIG. 5, the transfer mechanism 12 may be aligned perpendicular to the transfer means 8. As shown in FIG. 6, the transfer mechanism 12 and the housings 1*a* to 1*c* may be aligned in a row by changing the layout of the interface mechanism. Note that reference numerals in FIGS. 5 and 6 denote the same parts as in FIGS. 2 to 4.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A vertical heat-treating apparatus comprising:

at least three first housings which are aligned side by side with each other, each of which has a closed top portion, an upper portion storing a substantially vertically extending reactor body, and a lower portion storing an elevator for vertically moving a boat supporting a plurality of plate-like objects into said reactor body;

second housings for supplying at least one of a feed fluid and electric power, said second housings arranged to face said first housings with a space left therebetween for maintenance;

a transfer means disposed at a front side of said first housings for transporting the boat loaded with said objects to said first housings;

a boat liner, which is arranged to be movable along said transfer means, and which includes a boat mounting table for transferring the boat to said first housings;

a transfer device for transferring the objects from said boat liner to said elevator; and an interface mechanism for conveying the boat loaded with the object to said boat liner.

2. An apparatus according to claim 1, further comprising a transfer mechanism disposed adjacent to said transfer means and adapted to transfer the objects to the boat in a horizontal orientation.

3. An apparatus according to claim 2, further comprising an interface mechanism disposed between said transfer mechanism and said transfer means.

4. An apparatus according to claim 4, wherein said interface mechanism comprises a rail, a strut movably disposed along said rail, and a conversion arm rotatably mounted on said strut for moving the boat between horizontal and vertical orientations.

5. An apparatus according to claim 1, wherein a front surface of said first housings, said transfer means, said boat liner and said transfer device are confined within a clean room, and said space is located outside of said clean room.

6. The apparatus of claim 1, wherein the boat liner is adapted to carry the boat in a substantially vertical state.

7. The apparatus of claim 1, wherein said transfer means is a rail installed along the plurality of first housings.

* * * * *